US007571576B2

(12) United States Patent
Pruitt

(10) Patent No.: US 7,571,576 B2
(45) Date of Patent: Aug. 11, 2009

(54) DECKING SYSTEM

(75) Inventor: J. Thomas Pruitt, Charlotte, NC (US)

(73) Assignee: Phil S. Payne, Charlotte, NC (US)

( * ) Notice: Subject to any disclaimer, the term of this patent is extended or adjusted under 35 U.S.C. 154(b) by 373 days.

(21) Appl. No.: 11/532,765

(22) Filed: Sep. 18, 2006

(65) Prior Publication Data

US 2008/0066409 A1 Mar. 20, 2008

(51) Int. Cl.
*E04C 2/32* (2006.01)

(52) U.S. Cl. ..... 52/250; 52/650.3; 52/414; 52/674; 52/742.1; 52/319

(58) Field of Classification Search ..... 52/674, 52/336, 335, 319, 848, 650.3, 414, 742.1
See application file for complete search history.

(56) References Cited

U.S. PATENT DOCUMENTS 3,759,006 A * 9/1973 Tamboise ..... 52/406.1
3,994,111 A 11/1976 Papayoti
3,995,403 A * 12/1976 Nickell ..... 52/284
4,186,535 A * 2/1980 Morton ..... 52/250
4,285,173 A 8/1981 Grearson et al.
4,333,280 A * 6/1982 Morton ..... 52/167.1
4,443,981 A 4/1984 Weiss
5,483,773 A 1/1996 Parisien
5,625,995 A 5/1997 Martin
5,887,331 A 3/1999 Little
5,913,784 A 6/1999 Hite
6,240,682 B1 * 6/2001 James et al. ..... 52/90.2
6,311,443 B1 11/2001 Allazetta
6,314,699 B1 11/2001 West
6,415,581 B1 * 7/2002 Shipman et al. ..... 52/798.1
6,490,838 B2 12/2002 Summerford
6,513,785 B1 2/2003 Worley
6,601,360 B2 8/2003 Spiers (Continued)

FOREIGN PATENT DOCUMENTS

WO WO9503456 2/1995

OTHER PUBLICATIONS

Hamilton, Patricia. On Site With Parallam. JLC, New England Edition. Dec. 1995, 3 pgs.

*Primary Examiner*—Richard E Chilcot, Jr.
*Assistant Examiner*—Alp Akbasli
(74) *Attorney, Agent, or Firm*—Adams Intellectual Property Law, P.A.

(57) ABSTRACT

An apparatus for use in forming a deck includes a platform having alternating elevated and depressed sections defining a plurality of troughs for receiving a hardenable fill material such as concrete, and at least one elongate cover segment positioned on a terminal edge of the platform. The cover segment includes a first side that covers the terminal edge of the platform, a second side angled in relation to the first side, and a plurality of outwardly extending flanges positioned on the first side such that the flanges contact the elevated sections. The flanges sit on top of the elevated sections, and the second side of the cover piece is positioned underneath the depressed sections. The cover segment is maintained on the platform by frictional engagement of the flanges and the elevated section and frictional engagement of the second side of the cover segment with the depressed sections.

23 Claims, 15 Drawing Sheets

U.S. PATENT DOCUMENTS

| | | | | |
|---|---|---|---|---|
| 6,619,002 | B2 | 9/2003 | Pettit | |
| 6,874,288 | B1 | 4/2005 | Washa et al. | |
| 6,918,221 | B2 | 7/2005 | Williams | |
| 2002/0059766 | A1 | 5/2002 | Gregori | |
| 2003/0177735 | A1 * | 9/2003 | Seeba et al. | 52/726.2 |
| 2004/0128939 | A1 | 7/2004 | Kim et al. | |
| 2004/0144056 | A1 | 7/2004 | Morton et al. | |
| 2005/0257483 | A1 | 11/2005 | Wilhelmsson | |

* cited by examiner

DECKING SYSTEM

TECHNICAL FIELD AND BACKGROUND OF THE INVENTION

The invention relates to an elevated deck, and a method and apparatus for building a deck, particularly a concrete deck. The decking system of the present invention provides an efficient means for constructing a deck that requires minimal upkeep and maintenance. The decking system is particularly suited for residential applications, however, it can also be used in other environments such as commercial settings.

Most decks in residential settings are made of wood, which typically require regular maintenance as they are subject to decay and termite damage. Ultimately, a wooden deck must be totally replaced, requiring substantial labor to remove and discard the old structure and replace it with a new one.

In conventional deck construction, a recreational wooden deck is attached to the side of a house and typically involves a deck ledger being fastened to wall sheathing and flashed before finish siding is attached to the adjacent wall. A frame is then constructed out from the wall and supported by posts. Deck joists are connected to the deck ledger and the frame to underlay and support deck planking. In addition, existing raised decking systems require masonry support systems around the outer edges with a masonry "row lock" on the top of the supporting walls to retain a hardenable building fill material, which is typically concrete in such construction. A compacted fill is used to fill the void under the concrete or a metal pan system is used supported by and terminating at the masonry wall and "row lock" accordingly.

The present invention replaces the wooden deck system typically used in residential settings with a concrete deck. The present invention replaces the deck joists with metal pans which span from the house to a support beam, and provides a usable outdoor living area above while maintaining a relatively dry area below.

SUMMARY OF THE INVENTION

Therefore, it is an object of the present invention to provide a deck that can be attached to the outer band of a residence in a similar fashion as wooden decks are typically attached today.

It is another object of the invention to provide a concrete or similar deck that can be formed, poured and stamped with a decorative pattern.

It is yet another object of the invention to provide a deck that requires minimal maintenance, and is resistant to decay and termite infestation.

These and other objects of the present invention are achieved in the preferred embodiments disclosed below by providing an apparatus for use in forming a deck having a platform with alternating elevated and depressed sections that define at least one pan trough for receiving a hardenable fill material such as concrete, and an elongate cover segment positioned on a terminal edge of the platform. The cover segment includes a first side that covers the terminal edge of the platform, a second side angled in relation to the first side and positioned underneath the depressed section of the platform, and at least one outwardly extending flange positioned on the first side such that the flange contacts the elevated section of the platform.

According to a preferred embodiment of the invention, the flange sits on top of the elevated section, and the cover segment is maintained on the platform by frictional engagement of the flange and the elevated section and frictional engagement of the second side of the cover segment and the depressed section.

According to another preferred embodiment of the invention, the platform comprises a plurality of alternating elevated and depressed sections defining a plurality of troughs for receiving the hardenable fill material.

According to yet another preferred embodiment of the invention, the decking system includes a second elongate cover segment and a connector, and the first cover segment is positioned adjacent the second cover segment, the connector is positioned at a junction of the first and second cover segments, and the first and second cover segments are connected to each other by insertion a fastener in the connector and the first cover segment and a fastener in the connector and the second cover segment.

According to yet another preferred embodiment of the invention, the decking system includes a second elongate cover segment and a connector having first and second recessed portions for receiving an edge portion of a respective one of the first and second cover segments, in which the first and second cover segments are joined together by frictional engagement with the connector.

According to yet another preferred embodiment of the invention, the cover segment includes a plurality of outwardly extending flanges positioned on the first side such that each of the plurality of flanges contacts a respective one of the plurality of elevated sections of the platform, in which each of the plurality of flanges is attached to a respective one of the plurality of elevated sections.

According to yet another preferred embodiment of the invention, the plurality of flanges are formed by machine stamping a plurality of rectangular openings in the first side of the cover segment and bending a rectangular piece to an angle of about ninety degrees relative to the first side of the cover.

According to yet another preferred embodiment of the invention, each of the plurality of flanges sits on top of a respective one of the plurality of elevated sections of the platform.

According to yet another preferred embodiment of the invention, the plurality of flange members is attached to a respective one of the plurality of elevated sections by insertion of a fastening member through the flanges and the elevated sections.

According to yet another preferred embodiment of the invention, the second side of the cover segment is positioned underneath the plurality of depressed sections of the platform.

According to yet another preferred embodiment of the invention, the elevated section of the platform is attached to the cover segment by insertion of a fastener into the flange of the cover segment and the elevated section.

According to yet another preferred embodiment of the invention, the depressed section of the platform is attached to the cover segment by insertion of a fastener into the second side of the cover segment and the depressed section.

According to yet another preferred embodiment of the invention, the first side of the cover segment is substantially perpendicular to the second side.

According to yet another preferred embodiment of the invention, the cover segment includes a third side angled in relation to the first side. The third side extends substantially perpendicularly from a top end of the first side, the second side extends substantially perpendicularly from a base end of the first side, and the flange extends substantially perpendicularly from a position on the first side intermediate the top and base ends.

According to yet another preferred embodiment of the invention, the first side of the cover segment is substantially perpendicular to the elevated and depressed sections of the platform.

According to yet another preferred embodiment of the invention, a removable strip is positioned on a top surface of the third side of the cover. As such, removal of the strip reduces the amount of hardenable fill material on the top surface.

According to yet another preferred embodiment of the invention, the platform is mounted on at least one support member so that the platform is elevated above the ground surface.

According to yet another preferred embodiment of the invention, an apparatus for use in forming a deck includes a platform having alternating elevated and depressed sections defining at least one trough for receiving a hardenable fill material, and a plurality of flanges, in which each of the plurality of flanges extend substantially perpendicularly from a terminal edge of one of the elevated and depressed sections. An elongate cover segment covers the terminal edge of the platform and is attached to the flanges of the platform.

According to yet another preferred embodiment of the invention, a fastener is inserted through each of the plurality of flanges and the cover segment to attach the cover segment to the platform.

According to yet another preferred embodiment of the invention, a method of making a deck includes the steps of providing a platform having alternating elevated and depressed sections defining at least one trough for receiving a hardenable fill material, and providing an elongate cover segment for positioning on a terminal edge of the platform. The cover includes a first side adapted for covering the terminal edge of the platform, a second side angled in relation to the first section and adapted for positioning underneath the depressed section of the platform, and at least one outwardly extending flange positioned on the first side such that the flange contacts the elevated section. The cover segment is positioned on the terminal edge of the platform, and the second side of the cover segment is positioned underneath the depressed section of the platform. The flange is attached to the elevated section of the platform.

According to yet another preferred embodiment of the invention, concrete is poured on the platform.

BRIEF DESCRIPTION OF THE FIGURES

Some of the objects of the invention have been set forth above. Other objects and advantages of the invention will appear as the invention proceeds when taken in conjunction with the following drawings, in which.

DESCRIPTION OF THE PREFERRED EMBODIMENTS

Figure 1:
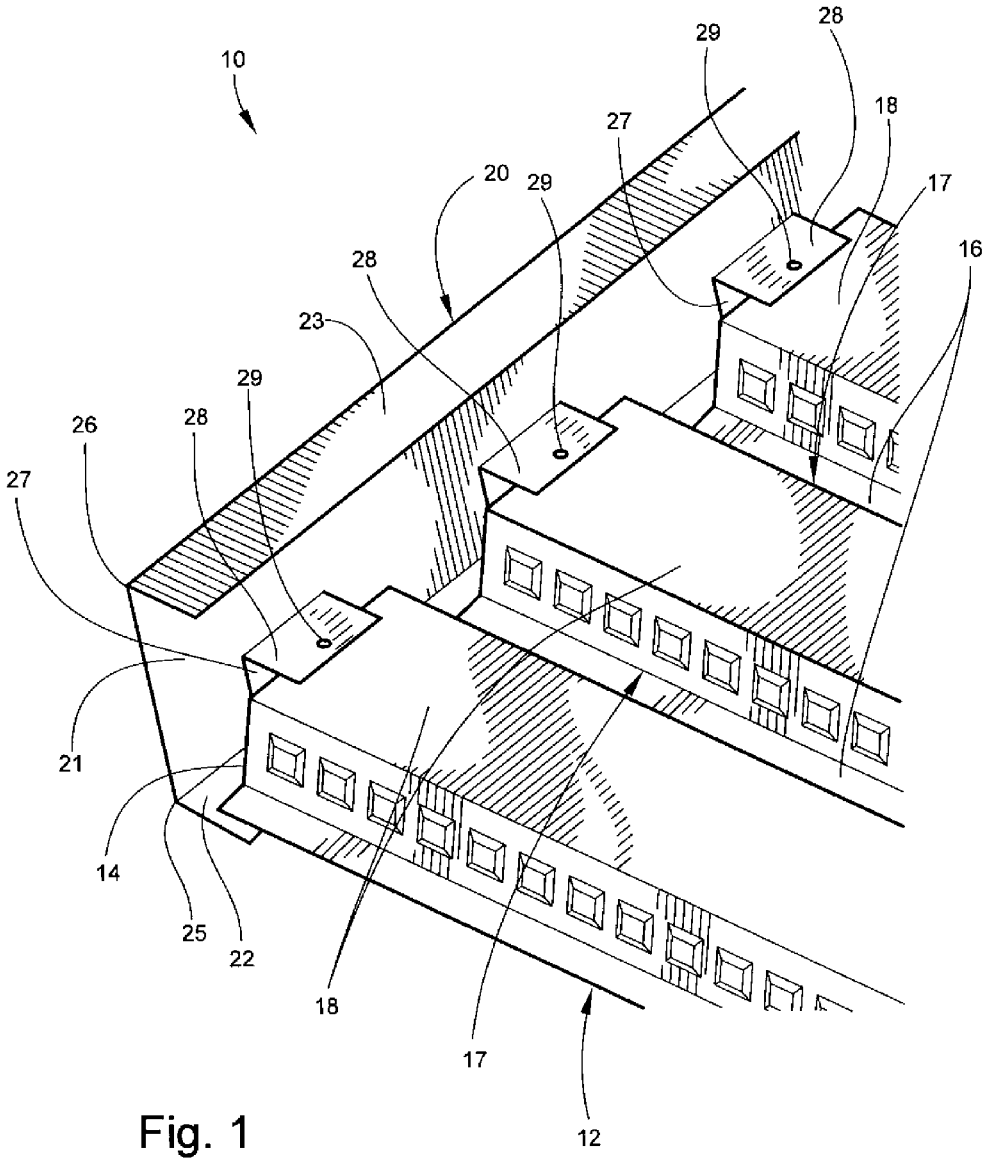
FIG. 1 is a partial perspective view of a decking system according to a preferred embodiment of the invention.

Referring now specifically to the drawings, an apparatus for use in forming a deck according to a preferred embodiment of the invention is illustrated in FIG. 1, and shown generally at reference numeral 10. The decking system 10 generally comprises a platform 12 and a cover piece 20. The platform 12 is preferably rectangular, and the cover piece 20 is positioned on a longitudinal edge 14 of the platform 12. The decking system 10 is particularly suited for building concrete decks, however, the decking system 10 can be used in conjunction with other suitable hardenable fill materials, such as grout, mortar, and various mixtures of water, sand, gravel crushed stones and/or other aggregates.

As shown in FIG. 1, the platform 12 is fluted such that it has alternating depressed sections 16 and elevated sections 18, thereby creating a pan with a series of troughs 17 that can receive concrete or other suitable hardening fill material. The platform 12 is preferably made of metal. The platform 12 is supported above the ground surface "G" by a support structure. The support structure can include beams (not shown) directly underneath the platform 12 supported by posts 50. The beams can be treated Parallam beams, treated wood two-by-tens or two-by-twelves, steel beams or other suitable structure. The posts can be metal tubes, treated wood four-by-fours or six-by-sixes, or other suitable structure.

The cover piece 20 is preferably made of metal, and has first, second and third sides 21, 22, 23, respectively. The first side 21 is sized to cover the longitudinal end 14 of the platform 12. The second side 22 extends outwardly from a base end 25 of the first side 21, and the third side 23 extends outwardly from the top end 26 of the first side 21. The second and third sides 22, 23, are preferably perpendicular to the first side 21, but can extend at other angles relative to the first side 21. Between the base end 25 and top end 26 of the first side 21, a plurality of flanges 28 extend outwardly from the first side 21. The flanges 28 are preferably perpendicular to the first side 21, but can be at other angles as well. The flanges 28 are shown in FIG. 1 to be positioned on the first side 21 about mid-way between the base end 25 and top end 26, however, the position of the flanges 28 on the first side 21 can vary depending on the depth of the troughs 17. The second side 22, third side 23 and flanges 28 all extend outwardly from the first side in the same direction.

Figure 2:
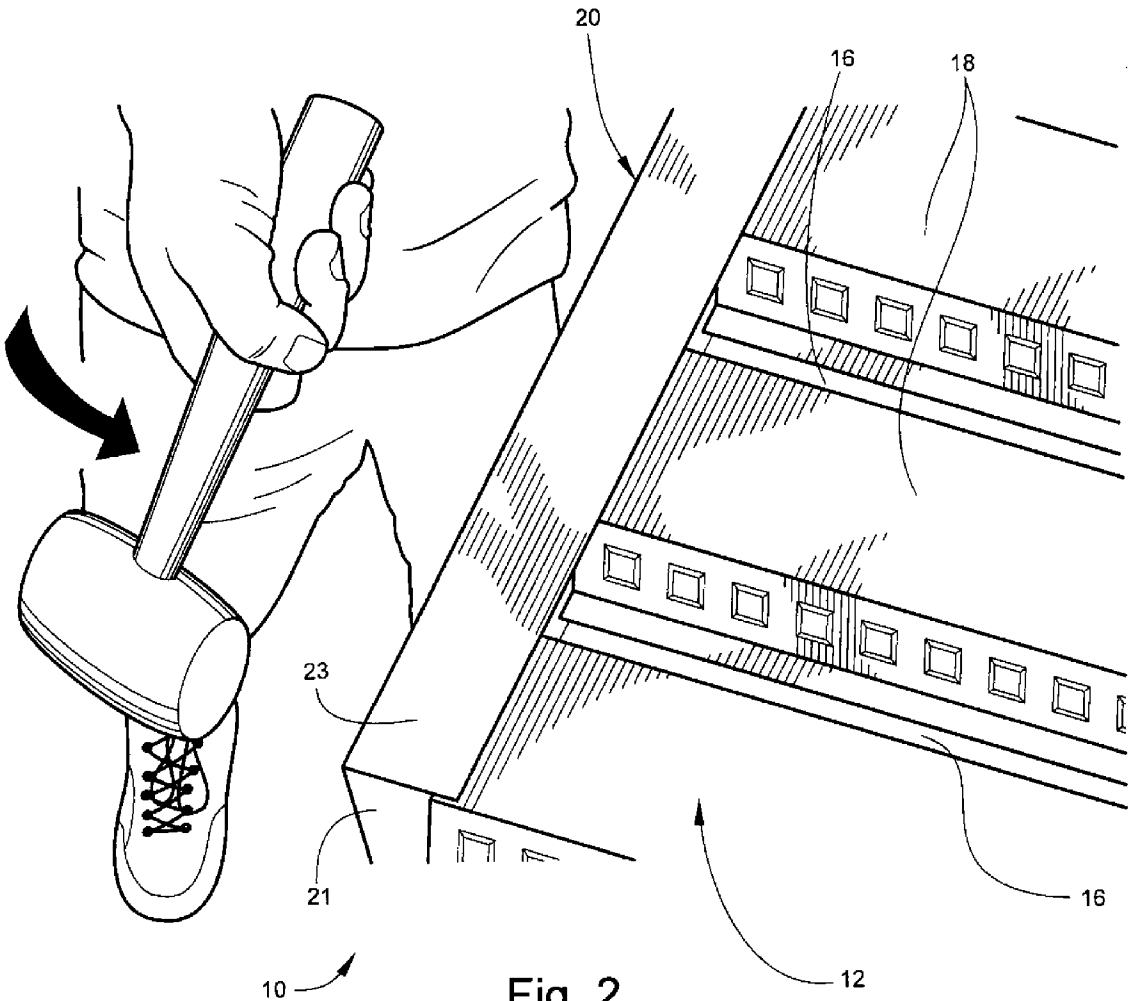
FIG. 2 is another partial perspective view of the decking system of FIG. 1.
Figure 3:
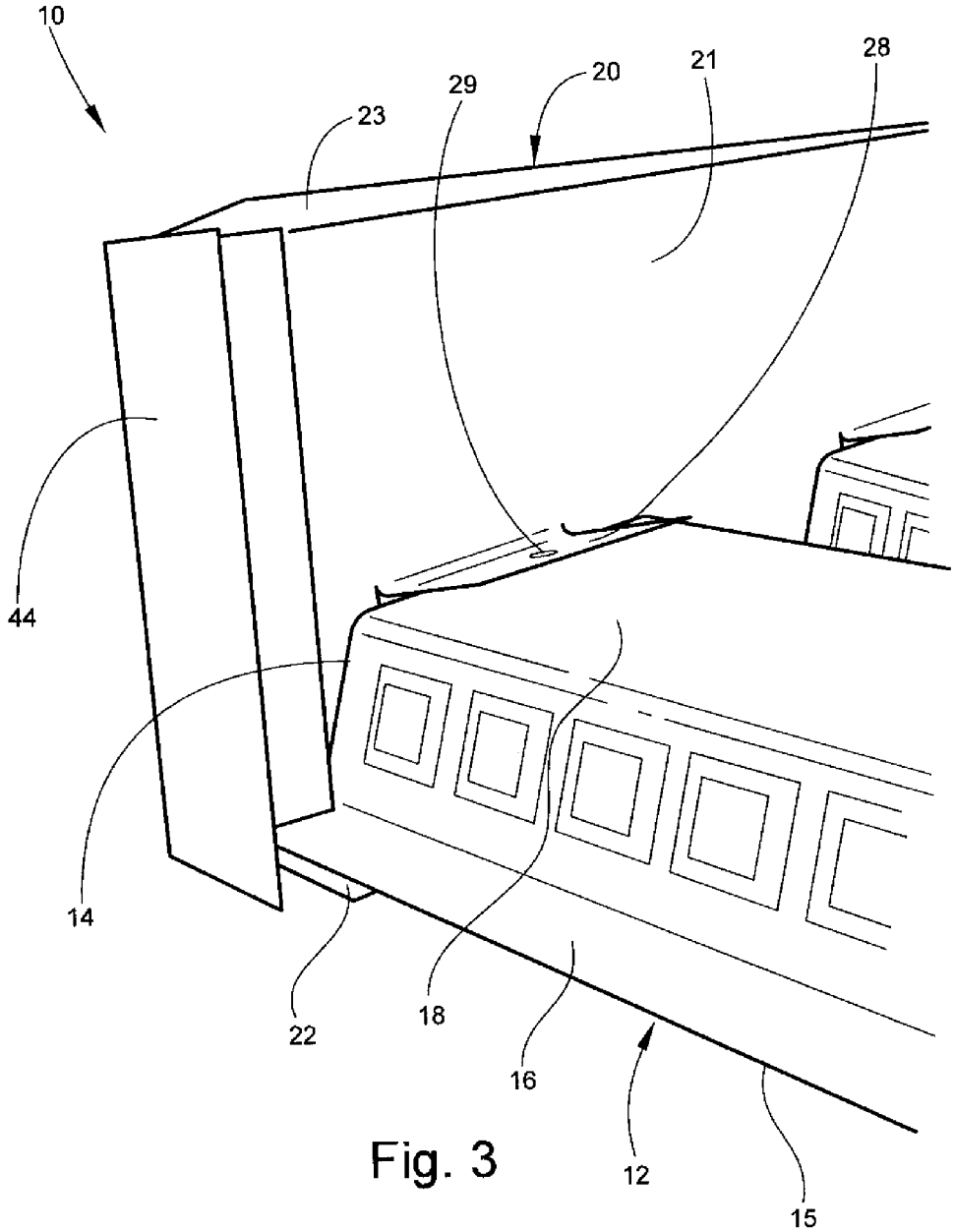
FIG. 3 is another partial perspective view of the decking system of FIG. 1.

The flanges 28 are positioned at a height on the first side 21 of the cover piece such that when the cover piece 20 is positioned on the longitudinal edge 14 of the platform 12, the second side 22 of the cover piece 20 is underneath and adjacent to the depressed sections 16 of the platform 12, and the flanges 28 are above and adjacent to the elevated sections 18 of the platform 12. As shown in FIG. 2, the cover piece 20 is placed onto the longitudinal edge 14 of the platform 12, and can be lightly hammered into position. Once in position, the cover piece 20 can be held in place on the longitudinal edge 14 of the platform 12 by the frictional engagement of the flanges 28 on the elevated sections 18 of the platform 12, and the second side 22 of the cover piece 20 with the depressed sections 16 of the platform 12, as shown in FIG. 3. The cover piece 20 is a self-bracing form that stays in place without outside bracing.

Figure 4:
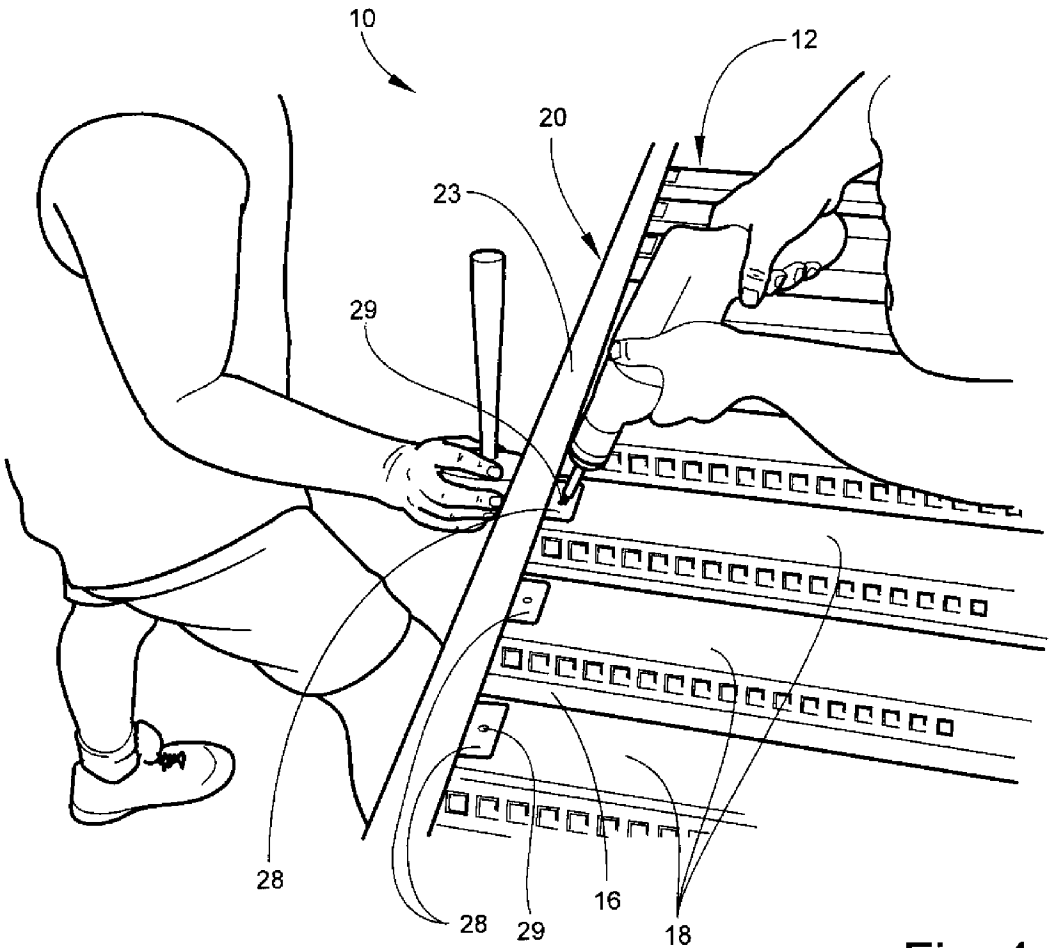
FIG. 4 is another partial perspective view of the decking system of FIG. 1.
Figure 5:
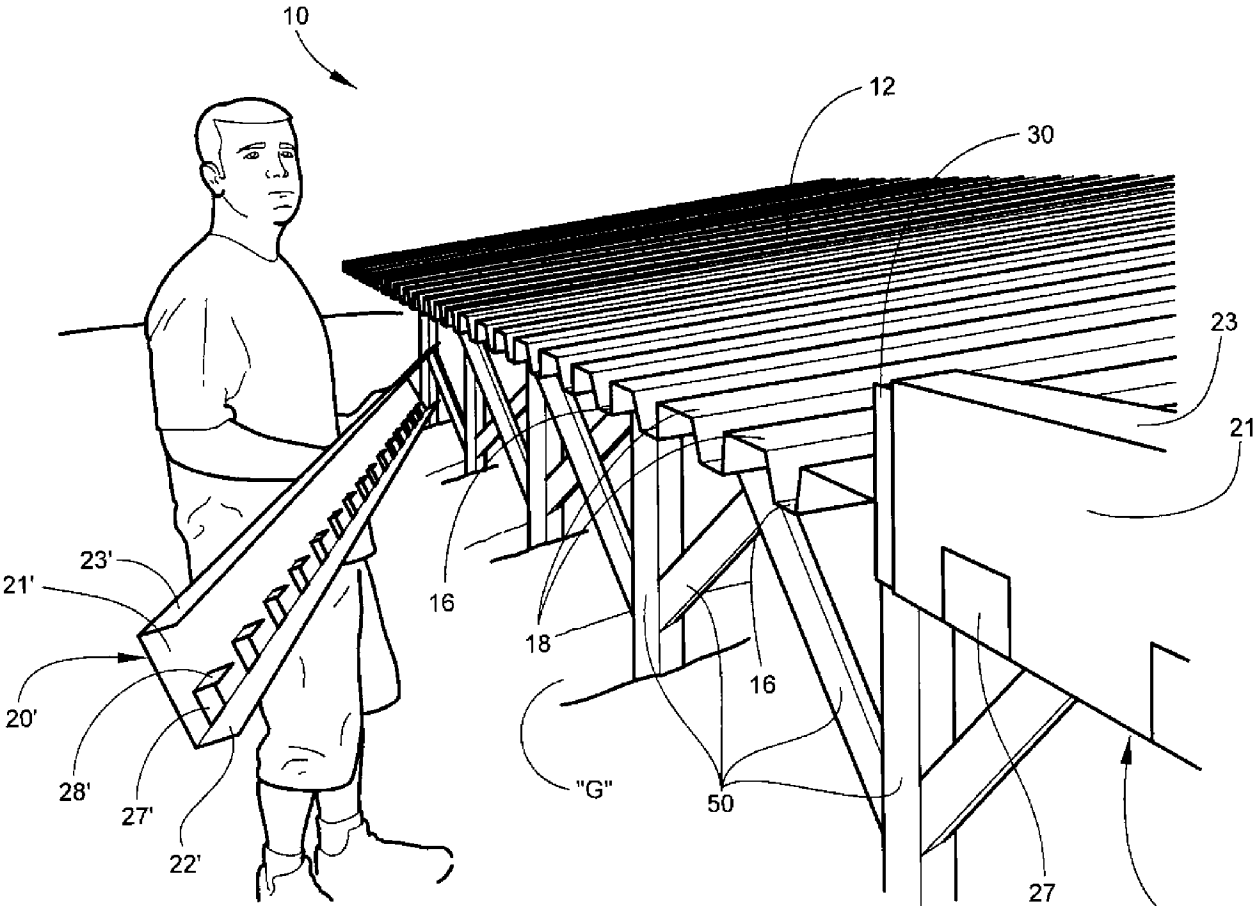
FIG. 5 is another partial perspective view of the decking system of FIG. 1.

The flanges 18 are preferably formed by machine stamping rectangular openings 27, 27' in the first side 21 of the cover piece 20, shown in FIG. 5, and bending the stamped out portion to an angle of approximately ninety degrees relative to the rest of the first side 21. Holes 29 can be formed in the flanges 28 to facilitate insertion of fasteners 39, such as screws, nails, pins or other fasteners, through the flanges 28 and into the elevated sections 18 of the platform 12 to securely attach the cover piece 20 to the platform 12, as shown in FIG. 4.

Figure 6:
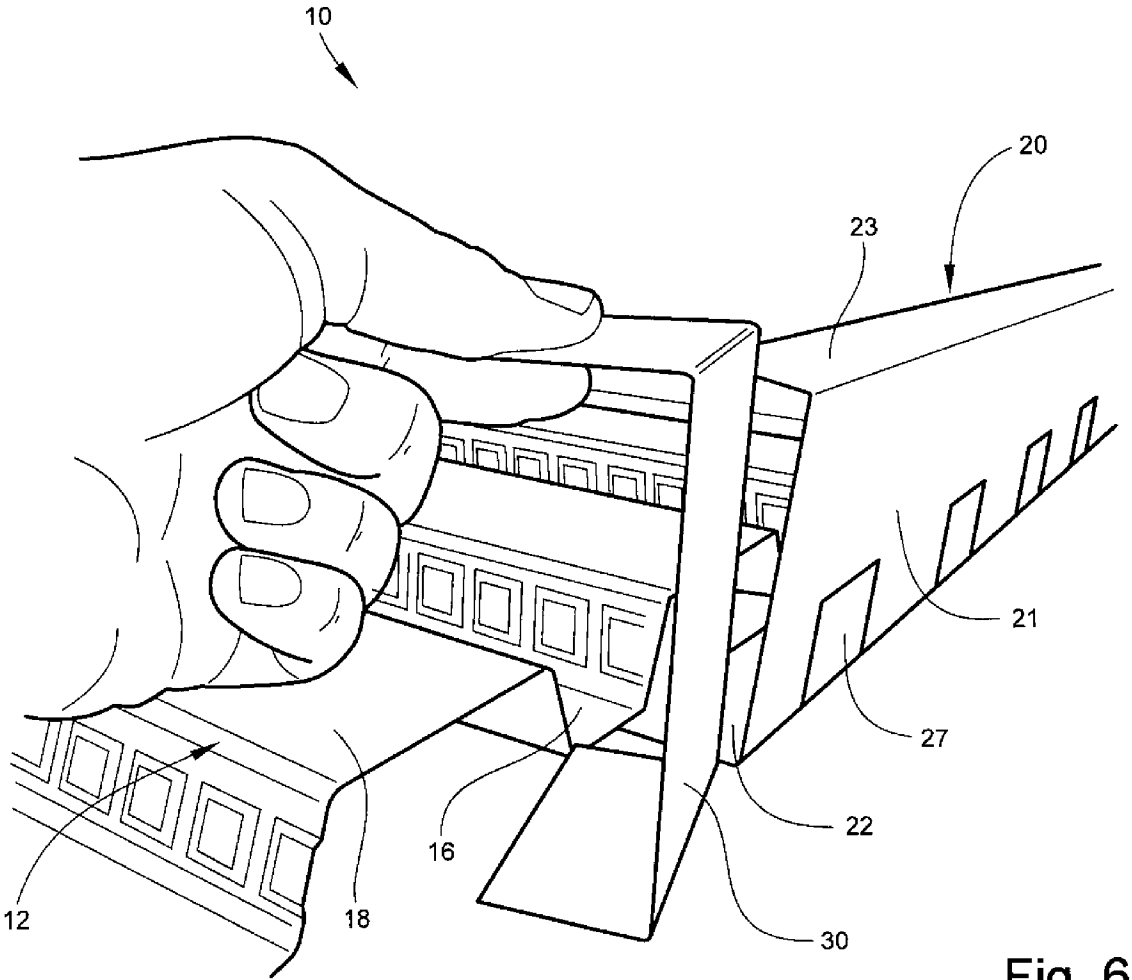
FIG. 6 is another partial perspective view of the decking system of FIG. 1.
Figure 7:
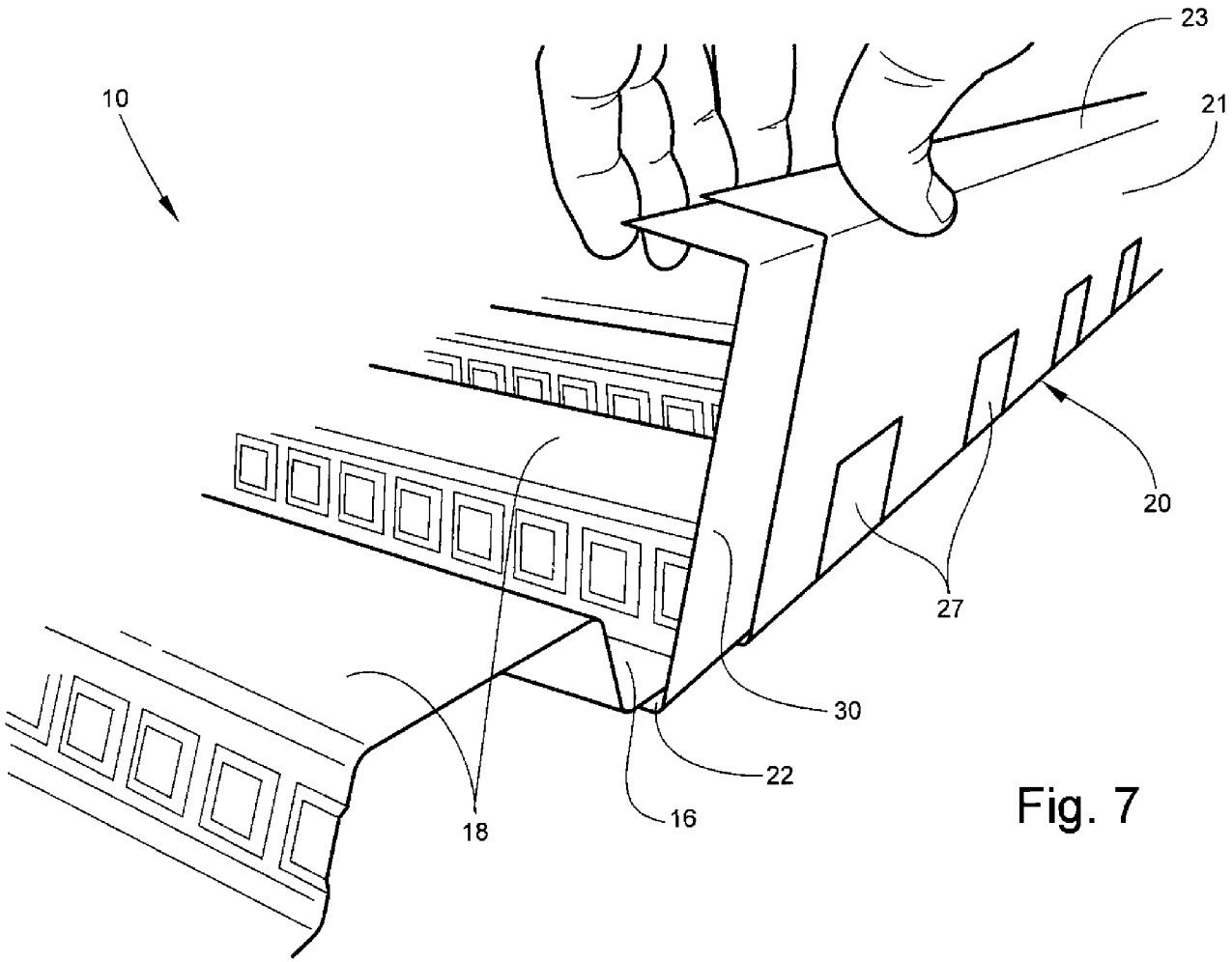
FIG. 7 is another partial perspective view of the decking system of FIG. 1.
Figure 8:
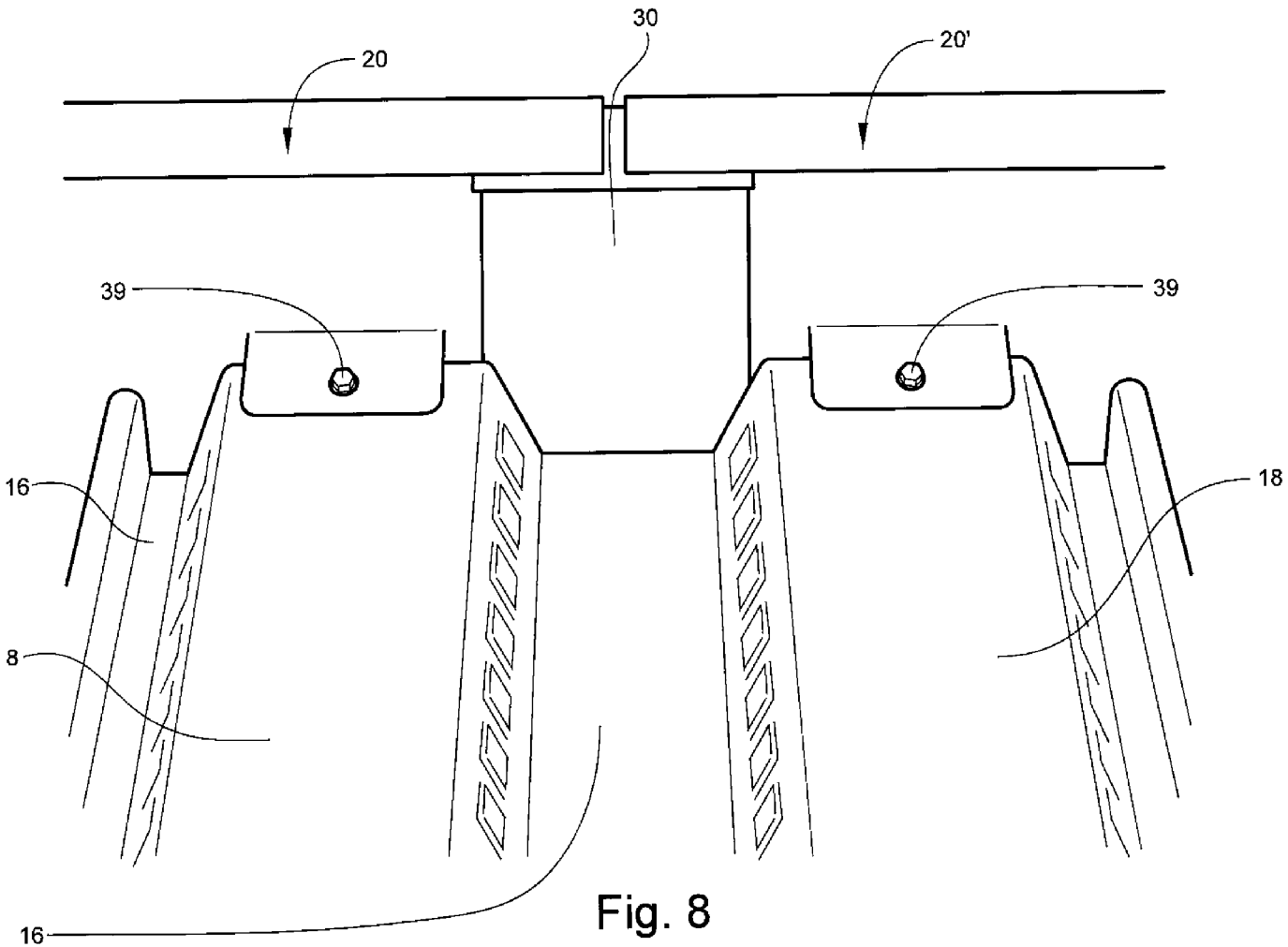
FIG. 8 is another partial perspective view of the decking system of FIG. 1.
Figure 9:
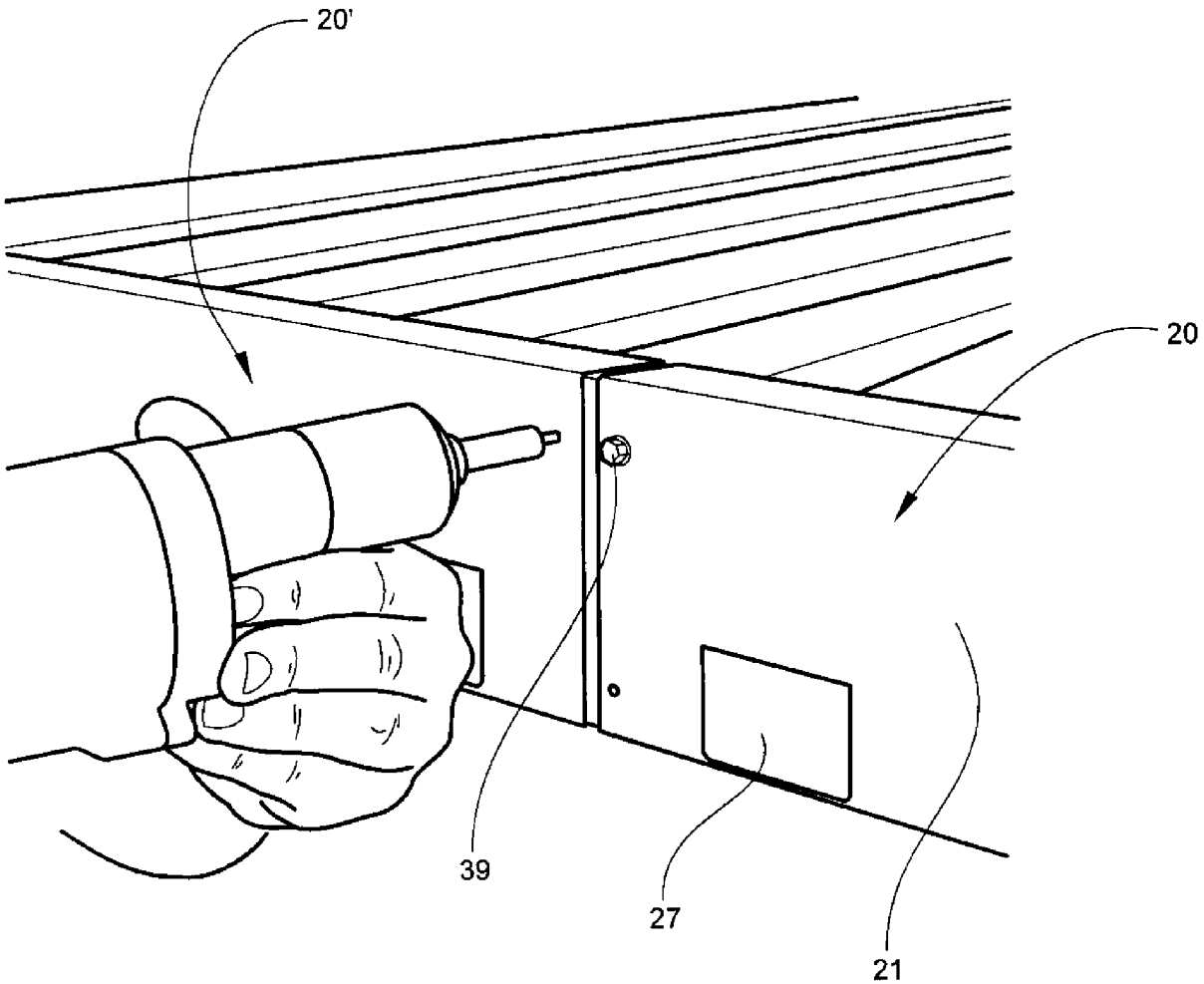
FIG. 9 is another partial perspective view of the decking system of FIG. 1.

Depending on the total length of the longitudinal end 14 of the platform 12, additional cover pieces can be utilized. For example, FIG. 5 illustrates a second cover piece 20' being positioned on the longitudinal end 14 of the platform 12 after the first cover piece 20. The second cover piece 20' is identical in structure to the first cover piece 20, and therefore is not described in further detail. The first and second cover pieces 20, 20' are joined together by a connector 30. The connector 30, which is similarly shaped as the cover pieces 20, 20', is inserted between the first cover piece 20 and the platform 12, such that a part of the connector 30 is between the first cover piece 20 and the platform 12, as shown in FIGS. 6 and 7. The second cover piece 20' is then positioned on the longitudinal end 14 of the platform 12 adjacent to the first cover piece 20, such that the second cover piece 20' contacts the exposed portion of the connector 30. As such, the connector 30 resides between the junction of the first and second cover pieces 20, 20' on one side, and the platform 12 on the other side, as shown in FIG. 8. The cover pieces 20, 20' can then be securely connected by inserting fasteners 39 through the cover pieces 20, 20' and into the connector 30, as shown in FIG. 9.

Figure 10:
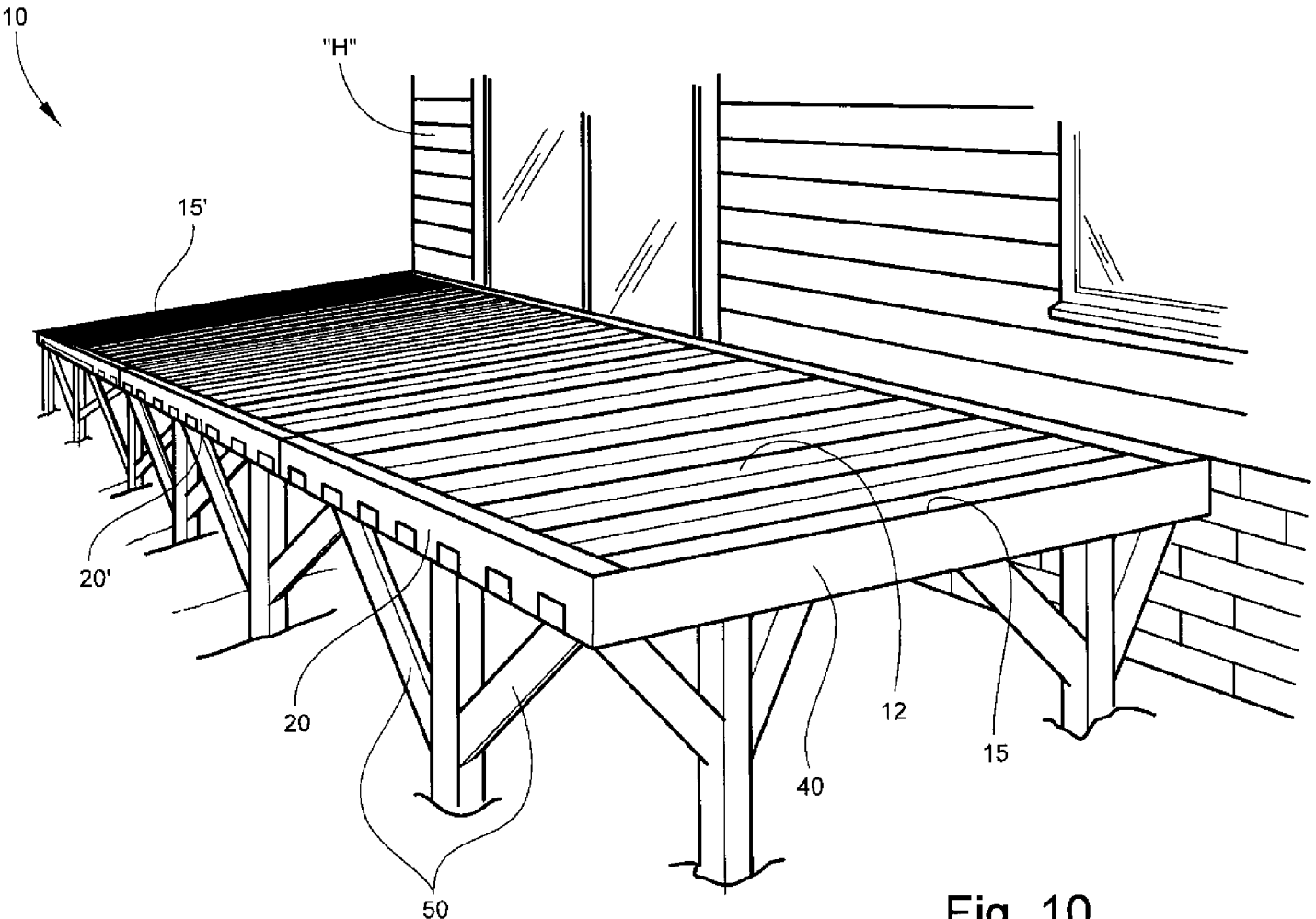
FIG. 10 is an environmental perspective view of the decking system of FIG. 1.
Figure 11:
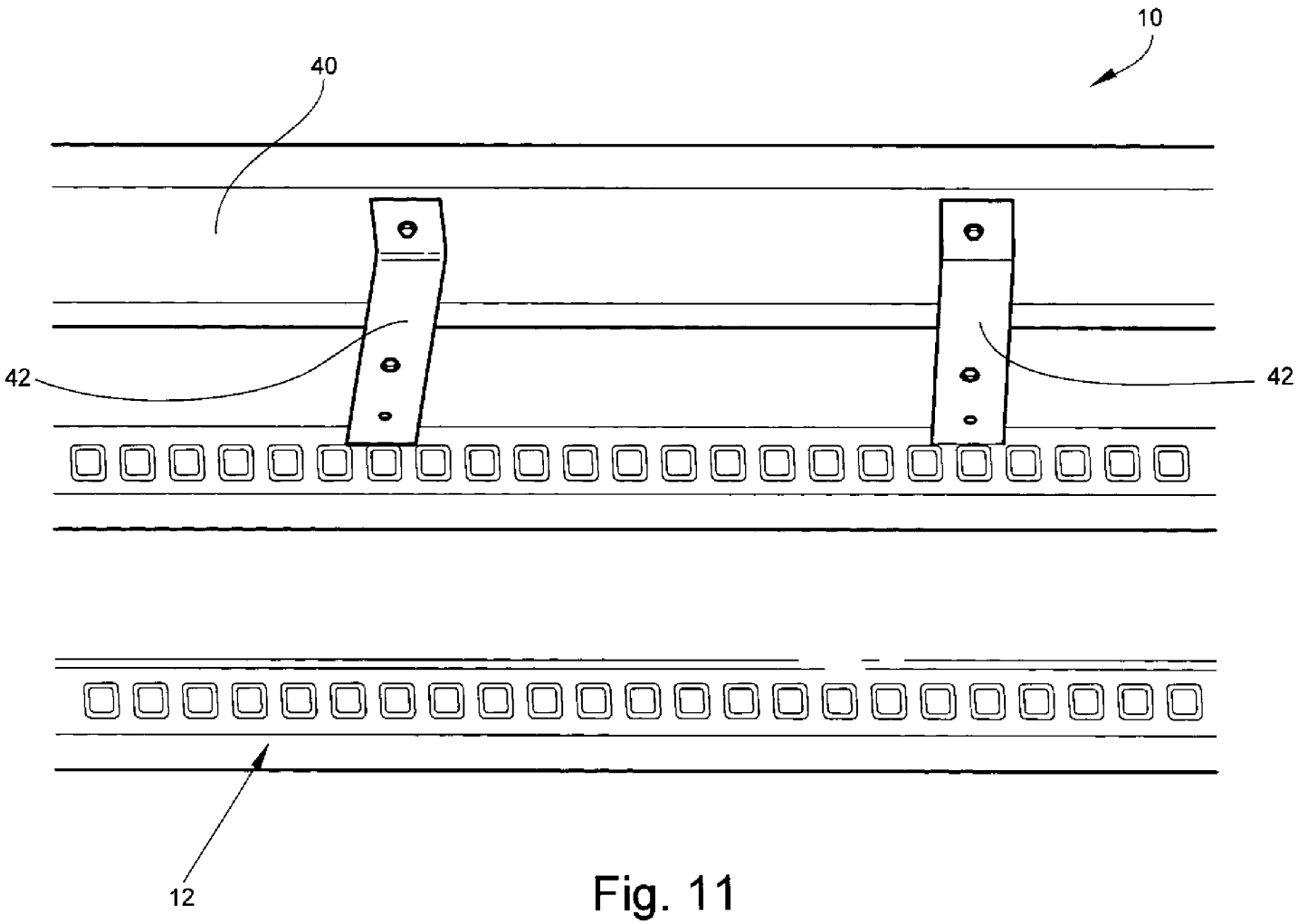
FIG. 11 is another partial perspective view of the decking system of FIG. 1.
Figure 12:
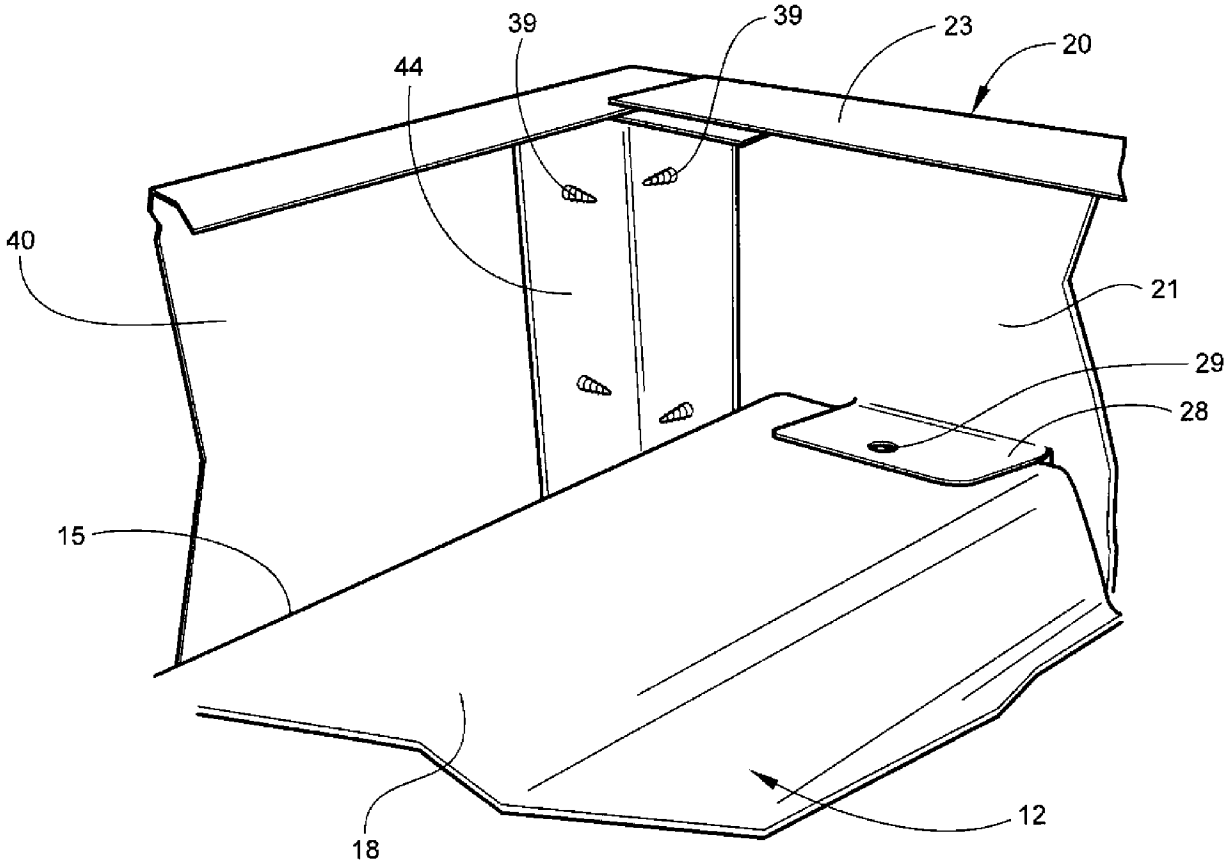
FIG. 12 is another partial perspective view of the decking system of FIG. 1.

As shown in FIG. 10, side pieces 40, 40' are mounted on the lateral edges 15, 15', respectively, of the platform 12. The side pieces 40, 40' are similar in structure to the cover pieces 20, 20', except that they do not have flanges 28. As shown in FIG. 11, side piece 40 is positioned on lateral edge 15 of the platform 12, and mounted thereon with L-brackets 42. The other side piece 40' is mounted on the other lateral edge 15' of the platform 12 in similar fashion, and therefore is not shown in further detail. Side piece 40 is connected to the cover pieces 20 using corner brackets 44, as shown in FIGS. 3 and 12. Side piece 40' is attached in a similar fashion, and therefore is not shown in further detail.

Maintaining the connectors 30, L-brackets 42 and corner brackets 44 inside of the cover pieces 20, 20' and side pieces 40, 40' provides an aesthetically pleasing appearance. In addition, a decorative piece (not shown) can be mounted on the cover pieces 20, 20' and side pieces 40, 40', and can be powder coated to allow for a black coating or other colors.

Figure 13:
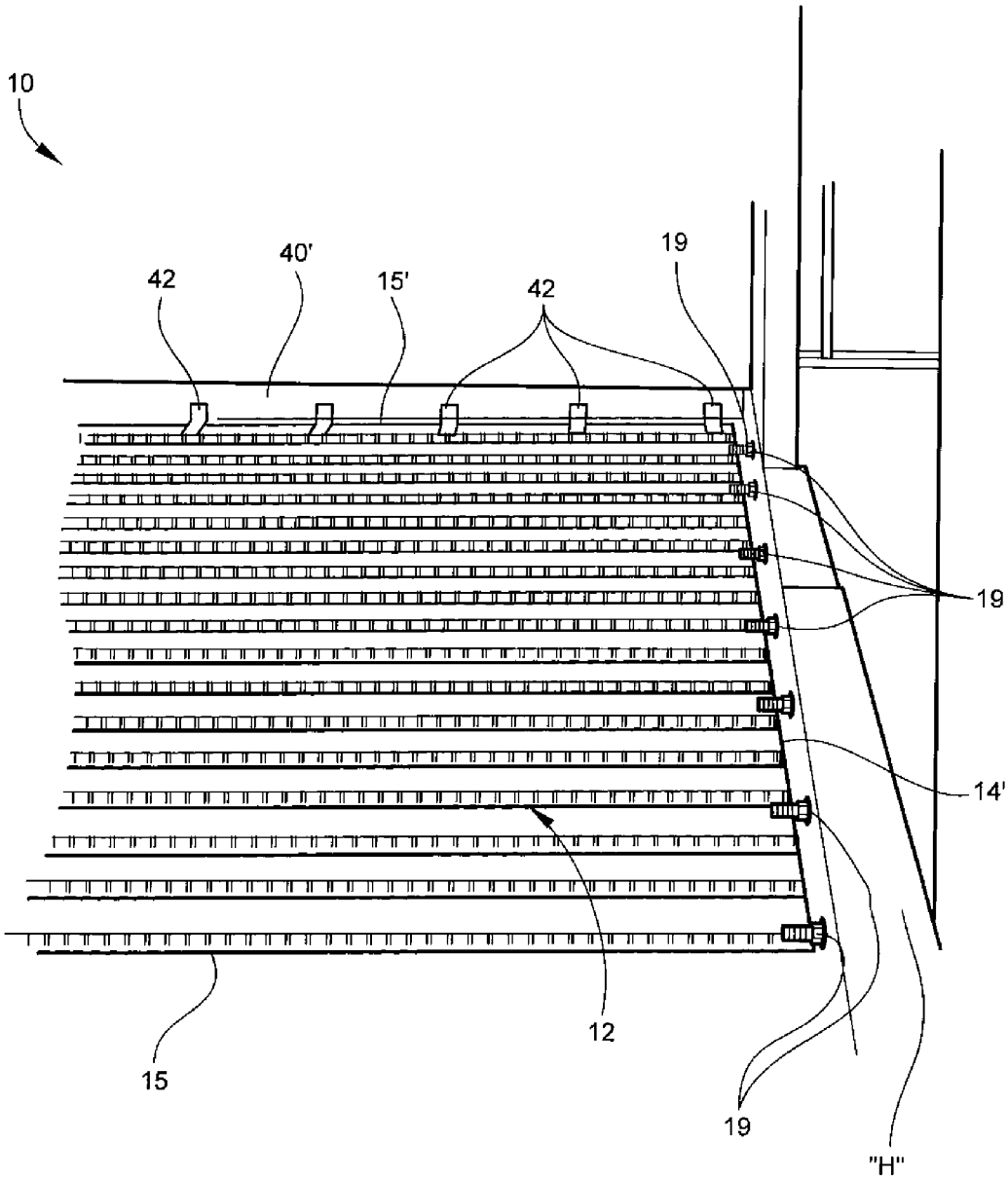
FIG. 13 is another partial perspective view of the decking system of FIG. 1.

As shown in FIG. 10, the decking system 10 is preferably used in conjunction with an adjoining building structure, such as house "H". The platform 12 includes a second longitudinal end 14' opposite the first longitudinal end 14 and proximate the house "H". As shown in FIG. 13, a plurality of threaded rods 19 are mounted at spaced apart intervals to the house "H" and extend approximately four to six inches onto the platform 12. As such, the exposed portions of the rods 19 are buried in the concrete when it is poured on the platform 12, thereby securely connecting the concrete to the house "H". This secure connection is particularly important in the event of an earthquake or other similar natural disaster.

Once assembled, concrete or other hardening fill material can be poured onto the platform 12 and allowed to harden. Once the concrete has hardened, a variety of flooring materials can be laid on the concrete to provide a functional and aesthetically pleasing floor surface for the deck. A variety of flooring imprints, such as brick, stone or wooden imprints can be utilized.

Figure 14:
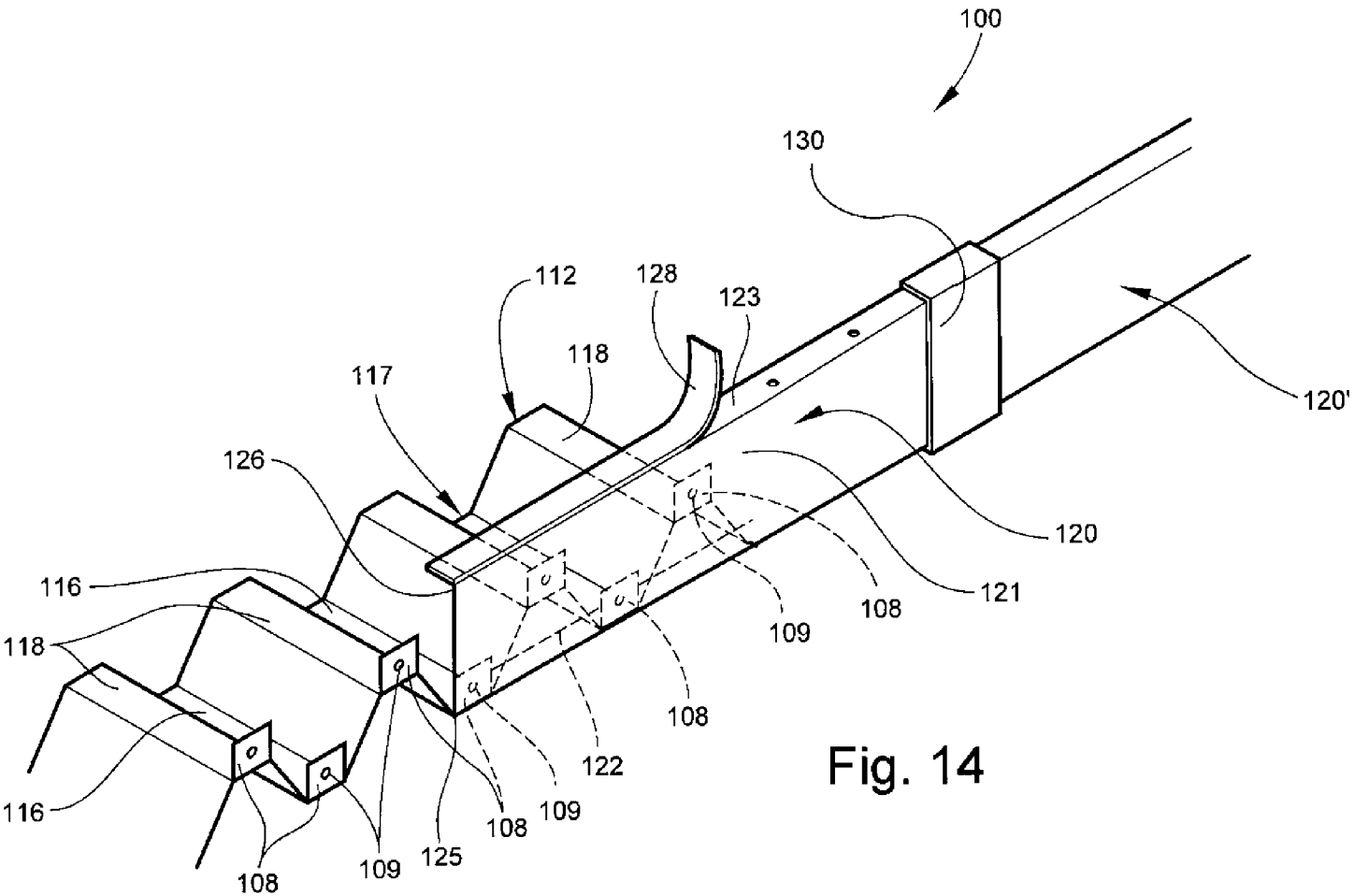
FIG. 14 is a perspective view of a decking system according to another preferred embodiment of the invention.

An alternative embodiment of a decking system according to a preferred embodiment of the invention is illustrated in FIG. 14, and shown generally at reference numeral 100. The decking system 100 generally comprises a platform 112 and a cover piece 120, both of which are preferably metal. The platform 112 is fluted such that it has alternating depressed sections 116 and elevated sections 118, thereby creating a series of troughs 117 that can receive concrete, or other suitable fill material. Flanges 108 extend upwardly from the depressed and elevated sections 116, 118 of the platform 112, at an angle of approximately 90 degrees relative to the depressed and elevated sections 116, 118.

The cover piece 120 has first, second and third sides 121, 122,123, respectively. The first side 121 is sized to cover the longitudinal end of the platform 112. The second side 122 extends perpendicularly from a base end 125 of the first side 121, and the third side 123 extends perpendicularly from the top end 126 of the first side 121.

The cover piece 120 is attached to the platform 112 by insertion of a fastener through holes 109 in the flanges 108 of the platform 112 and into the first side 121 of the cover piece 120. A removable strip 128 can be placed on the top surface of the third side 123 of the cover piece 120. The strip 128 protects the cover piece 120 from concrete while pouring. After the concrete has been poured, stamped and has been set up, the strip 128 is removed and discarded and a decorative "C" channel piece can be installed to the cover piece 120. Another benefit of the strip 125 is to create a recessed area for the decorative piece to fit. This allows for cleaning of the deck 100 without debris collecting on the edge of the deck 100 under the top edge of the recessed area. In addition, it provides a finished edge to the concrete and may be powder coated to match railings used on the deck 100.

Figure 15:
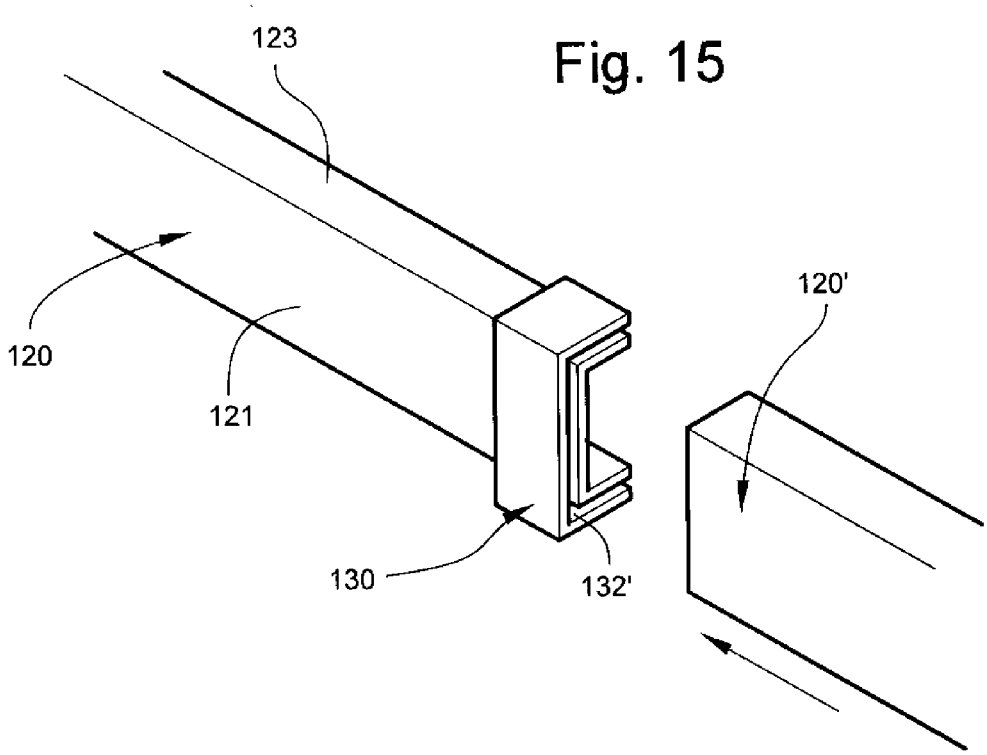
FIG. 15 is a partial perspective view of the decking system of FIG. 13.
Figure 16:
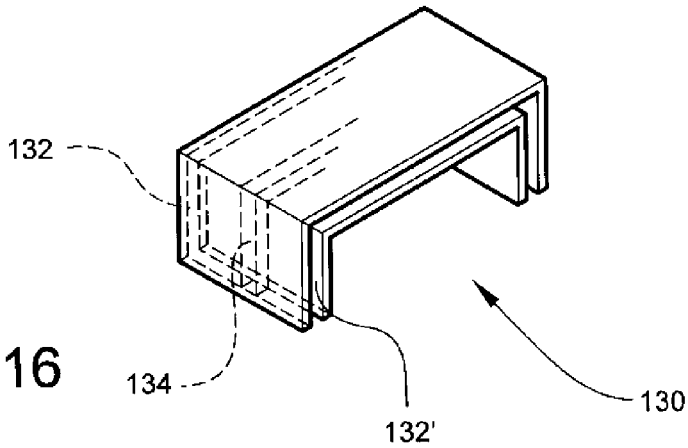
FIG. 16 is a perspective view of a component of the decking system of FIG. 13.

In order to accommodate various sizes of platform 112, additional cover pieces can be utilized by use of a connector 130. As shown in FIG. 14, a second cover piece 120' can be connected to the first cover piece 120 via connector 130. The connector 130 has the same general U-shape of the cover pieces 120, 120'. As shown in FIG. 15, the connector 130 has two C-channels 132, 132' recessed in opposite sides of the connector 130 for receiving longitudinal edge portions of the cover pieces 120, 120', respectively. A median section 134 of the connector 130 divides the C-channels 132, 132'. The C-channels 132, 132' are shaped and sized such that the connector 130 frictionally engages the cover pieces 120, 120'. As such, the cover pieces 120, 120' can be joined together by the connector 130, as shown in FIG. 14, and is held in place without the need for fasteners such as bolts or pins. In addition, the connector 130 hides the edges of the cover pieces 120, 120'.

A decking system and method of using same are described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. An apparatus for use in forming a deck comprising:

(a) a platform having alternating elevated and depressed sections defining at least one trough for receiving a hardenable fill material; and (b) a first elongate cover segment positioned on a terminal edge of the platform, comprising:

(i) a first side adapted for covering at least a portion of the terminal edge of the platform, (ii) a second side angled in relation to the first side and positioned underneath the depressed section of the platform, (iii) at least one outwardly extending flange positioned on the first side such that the flange contacts the elevated section; and (iv) a third side angled in relation to the first side;

wherein the third side extends substantially perpendicularly from a top end of the first side, the second side extends substantially perpendicularly from a base end of the first side and the flange extends substantially perpendicularly from a position on the first side intermediate the top and base ends.

2. An apparatus according to claim 1, wherein the flange sits on top of the elevated section, and the cover segment is maintained on the platform by frictional engagement of the flange and the elevated section and frictional engagement of the second side of the cover segment and the depressed section.

3. An apparatus according to claim 1, wherein the platform comprises a plurality of alternating elevated and depressed sections defining a plurality of troughs for receiving the hardenable fill material.

4. An apparatus according to claim 3, further comprising a second elongate cover segment and a connector, and wherein the first cover segment is positioned adjacent the second cover segment, the connector is positioned at a junction of the first and second cover segments, and the first and second cover segments are connected to each other by insertion a fastener in the connector and the first cover segment and a fastener in the connector and the second cover segment.

5. An apparatus according to claim 3, further comprising a second elongate cover segment and a connector having first and second recessed portions for receiving an edge portion of a respective one of the first and second cover segments, wherein the first and second cover segments are joined together by frictional engagement with the connector.

6. An apparatus according to claim 3, wherein the cover segment includes a plurality of outwardly extending flanges positioned on the first side such that each of the plurality of flanges contacts a respective one of the plurality of elevated sections of the platform, wherein each of the plurality of flanges is attached to a respective one of the plurality of elevated sections.

7. An apparatus according to claim 6, wherein the plurality of flanges are formed by machine stamping a plurality of rectangular openings in the first side of the cover segment and bending a rectangular piece to an angle of about ninety degrees relative to the first side of the cover.

8. An apparatus according to claim 6, wherein each of the plurality of flanges sits on top of a respective one of the plurality of elevated sections of the platform.

9. An apparatus according to claim 8, wherein each of the plurality of flange members is attached to a respective one of the plurality of elevated sections by insertion of a fastening member through the flanges and the elevated sections.

10. An apparatus according to claim 8, wherein the second side of the cover segment is positioned underneath the plurality of depressed sections of the platform.

11. An apparatus according to claim 1, wherein the elevated section of the platform is attached to the cover segment by insertion of a fastener into the flange of the cover segment and the elevated section.

12. An apparatus according to claim 1, wherein the depressed section of the platform is attached to the cover segment by insertion of a fastener into the second side of the cover segment and the depressed section.

13. An apparatus according to claim 1, wherein the first side of the cover segment is substantially perpendicular to the second side.

14. An apparatus according to claim 13, wherein the at least one flange extends substantially perpendicularly from the first side of the cover segment.

15. An apparatus according to claim 1, wherein the first side of the cover segment is substantially perpendicular to the elevated and depressed sections of the platform.

16. An apparatus according to claim 1, further comprising a removable strip positioned on a top surface of the third side, whereby removal of the strip can reduce the amount of hardenable fill material on the top surface.

17. An apparatus according to claim 1, further comprising at least one support member on which the platform is mounted to support the platform on a ground surface, whereby the platform is elevated above the ground surface.

18. An apparatus according to claim 1, wherein the hardenable fill material comprises concrete.

19. An apparatus for use in forming a deck comprising:

(a) a platform having alternating elevated and depressed sections defining at least one trough for receiving a hardenable fill material, and a plurality of flanges, wherein each of the plurality of flanges extend substantially perpendicularly from a terminal edge of one of the elevated and depressed sections; and (b) an elongate cover segment adapted for covering the terminal edge of the platform and attached to the flanges of the platform, the elongate cover comprising:

(i) a first side adapted for covering at least a portion of the terminal edge of the platform, (ii) a second side angled in relation to the first side and positioned underneath the depressed section of the platform, (iii) at least one outwardly extending flange positioned on the first side such that the flange contacts the elevated section; and (iv) a third side angled in relation to the first side;

wherein the third side extends substantially perpendicularly from a top end of the first side, the second side extends substantially perpendicularly from a base end of the first side and the flange extends substantially perpendicularly from a position on the first side intermediate the top and base ends.

20. An apparatus according to claim 19, wherein a fastener is inserted through each of the plurality of flanges and the cover segment to attach the cover segment to the platform.

21. A method of making a deck comprising the steps of:

(a) providing a platform having alternating elevated and depressed sections defining at least one trough for receiving a hardenable fill material; and (b) providing an elongate cover segment for positioning on a terminal edge of the platform, the cover segment comprising:

(i) a first side adapted for covering the terminal edge of the platform, (ii) a second side angled in relation to the first section and adapted for positioning underneath the depressed section of the platform, (iii) at least one outwardly extending flange positioned on the first side such that the flange contacts the elevated section; and (iv) a third side angled in relation to the first side;

wherein the third side extends substantially perpendicularly from a top end of the first side, the second side extends substantially perpendicularly from a base end of the first side, and the flange extends substantially perpendicularly from a position on the first side intermediate the top and base ends; and (c) positioning the cover segment on the terminal edge of the platform by positioning the second side of the cover segment underneath the depressed section of the platform, and attaching the flange to the elevated section of the platform.

22. A method according to claim 21, further comprising the step of mounting the platform on a plurality of support members whereby the platform is elevated above a ground surface.

23. A method according to claim 21, further comprising the step of pouring concrete on the platform.

* * * * *